US010109473B1

(12) United States Patent
Blondia et al.

(10) Patent No.: US 10,109,473 B1
(45) Date of Patent: Oct. 23, 2018

(54) MECHANICALLY SEALED TUBE FOR LASER SUSTAINED PLASMA LAMP AND PRODUCTION METHOD FOR SAME

(71) Applicant: Excelitas Technologies Corp., Waltham, MA (US)

(72) Inventors: Rudi Blondia, Stockton, CA (US); Douglas A. Doughty, Gilroy, CA (US); John Kiss, San Jose, CA (US); Roy D. Roberts, Hayward, CA (US)

(73) Assignee: Excelitas Technologies Corp., Waltham, MA (US)

( * ) Notice: Subject to any disclaimer, the term of this patent is extended or adjusted under 35 U.S.C. 154(b) by 0 days.

(21) Appl. No.: 15/880,754

(22) Filed: Jan. 26, 2018

(51) Int. Cl.

| | |
|---|---|
| ***H01J 61/36*** | (2006.01) |
| ***H01J 61/54*** | (2006.01) |
| ***H01J 61/02*** | (2006.01) |
| ***H01J 61/06*** | (2006.01) |
| ***H05H 1/46*** | (2006.01) |
| *H01J 61/16* | (2006.01) |

(52) U.S. Cl.
CPC ..... *H01J 61/361* (2013.01); *H01J 61/025* (2013.01); *H01J 61/06* (2013.01); *H01J 61/54* (2013.01); *H05H 1/46* (2013.01); *H01J 61/16* (2013.01)

(58) Field of Classification Search
CPC ..... H01J 61/361; H01J 61/06; H01J 61/54; H01J 61/025; H01J 61/16; H01J 61/30; H05H 1/46; H01K 1/28
See application file for complete search history.

(56) References Cited

U.S. PATENT DOCUMENTS 3,502,929 A 3/1970 Richter
3,515,491 A 6/1970 Emary
(Continued)

FOREIGN PATENT DOCUMENTS

DE 243629 3/1987
DE 10 2011 113681 3/2013
(Continued)

OTHER PUBLICATIONS

H.M. Pask, et al, Ytterbium-Doped Silica Fiber Lasers: Versatile Sources for the 1-1.2 um Region; IEEE Journal of Selected Topics in Quantum Electronics vol. 1, No. 1; Apr. 1993.
(Continued)

*Primary Examiner* — Joseph L Williams
*Assistant Examiner* — Jose M Diaz
(74) *Attorney, Agent, or Firm* — Peter A. Nieves; Sheehan Phinney Bass & Green PA

(57) ABSTRACT

A laser sustained plasma lamp includes a mechanically sealed pressurized chamber assembly (330) configured to contain an ionizable material. The chamber assembly is bounded by a chamber tube (310), an ingress sapphire window (340), a first metal seal ring (320) configured to seal against the chamber tube ingress end and the ingress sapphire window, an egress sapphire window (342), and a second metal seal ring (322) configured to seal against the chamber tube egress end and the egress sapphire window. A mechanical clamping structure (350, 355) external to the chamber assembly is configured to clamp across at least a portion of the ingress sapphire window and the egress sapphire window. The ingress sapphire window and the egress sapphire window are not connected to the chamber tube via welding and/or brazing.

16 Claims, 6 Drawing Sheets

(56) References Cited

U.S. PATENT DOCUMENTS

| | | | |
|---|---|---|---|
| 3,619,588 | A | 11/1971 | Chambers |
| 3,808,496 | A | 4/1974 | McRae et al. |
| 3,826,996 | A | 7/1974 | Jaegle |
| 3,900,803 | A | 8/1975 | Silfvast et al. |
| 4,088,966 | A | 5/1978 | Samis |
| 4,152,625 | A | 5/1979 | Conrad |
| 4,286,239 | A | 8/1981 | Gross |
| 4,420,690 | A | 12/1983 | Kuehl |
| 4,498,029 | A | 2/1985 | Yoshizawa |
| 4,622,464 | A | 11/1986 | Suktgara et al. |
| 4,646,215 | A | 2/1987 | Levin |
| 4,710,673 | A | 12/1987 | Vrijssen et al. |
| RE32,626 | E | 3/1988 | Yoshizawa |
| 4,738,748 | A | 4/1988 | Kisa |
| 4,780,608 | A | 10/1988 | Cross et al. |
| 4,789,788 | A | 12/1988 | Cox |
| 4,866,517 | A | 9/1989 | Mochizuki et al. |
| 4,901,330 | A | 2/1990 | Wolfram |
| 5,432,398 | A | 7/1995 | Kogelschatz |
| 5,747,813 | A | 5/1998 | Norton et al. |
| 5,798,805 | A | 8/1998 | Ooi |
| 5,905,268 | A | 5/1999 | Garcia et al. |
| 5,940,182 | A | 8/1999 | Lepper, Jr. et al. |
| 6,184,517 | B1 | 2/2001 | Sawada |
| 6,212,989 | B1 | 4/2001 | Beyer et al. |
| 6,285,743 | B1 | 9/2001 | Hiroyuki |
| 6,288,780 | B1 | 9/2001 | Fairley et al. |
| 6,324,255 | B1 | 11/2001 | Kondo et al. |
| 6,325,255 | B1 | 12/2001 | Lane et al. |
| 6,356,700 | B1 | 3/2002 | Strobl |
| 6,414,436 | B1 | 7/2002 | Eastlund |
| 6,417,625 | B1 | 7/2002 | Brooks et al. |
| 6,541,924 | B1 | 4/2003 | Kane et al. |
| 6,587,195 | B1 | 7/2003 | Jennings |
| 6,679,276 | B1 | 1/2004 | Brown et al. |
| 6,737,809 | B2 | 5/2004 | Espiau et al. |
| 6,762,849 | B1 | 7/2004 | Ruikens |
| 6,788,404 | B2 | 9/2004 | Lange |
| 6,956,329 | B2 | 10/2005 | Brooks et al. |
| 6,960,872 | B2 | 11/2005 | Beeson |
| 6,972,421 | B2 | 12/2005 | Melnychuk |
| 7,050,149 | B2 | 5/2006 | Owa et al. |
| 7,294,839 | B2 | 11/2007 | Rich et al. |
| 7,295,739 | B2 | 11/2007 | Solarz |
| 7,307,375 | B2 | 12/2007 | Smith |
| 7,390,116 | B2 | 6/2008 | Jain |
| 7,427,167 | B2 | 9/2008 | Holder et al. |
| 7,429,818 | B2 | 9/2008 | Chang et al. |
| 7,435,982 | B2 | 10/2008 | Smith |
| 7,439,530 | B2 | 10/2008 | Ershov |
| 7,652,430 | B1 | 1/2010 | Delgado |
| 7,679,276 | B2 | 3/2010 | Blondia |
| 7,744,241 | B2 | 6/2010 | Xu |
| 7,786,455 | B2 | 8/2010 | Smith |
| 7,989,786 | B2 | 8/2011 | Smith |
| 8,192,053 | B2 | 6/2012 | Owen et al. |
| 8,242,671 | B2 | 8/2012 | Blondia et al. |
| 8,242,695 | B2 | 8/2012 | Sumitomo |
| 8,253,926 | B2 | 8/2012 | Sumitomo et al. |
| 8,288,947 | B2 | 10/2012 | Yokota et al. |
| 8,309,943 | B2 | 11/2012 | Smith |
| 8,525,138 | B2 | 9/2013 | Smith |
| 8,702,465 | B2 | 4/2014 | Guthrie et al. |
| 8,969,841 | B2 | 3/2015 | Smith |
| 9,024,252 | B2 | 5/2015 | Chiarello et al. |
| 9,048,000 | B2 | 6/2015 | Smith |
| 9,185,786 | B2 | 11/2015 | Smith |
| 9,230,771 | B2 | 1/2016 | Raggio |
| 9,530,636 | B2 | 12/2016 | Oh et al. |
| 2001/0016430 | A1 | 8/2001 | Nakano |
| 2001/0035720 | A1 | 11/2001 | Guthrie et al. |
| 2002/0017399 | A1 | 2/2002 | Chang |
| 2002/0021508 | A1 | 2/2002 | Ishihara |
| 2002/0044629 | A1 | 4/2002 | Hertz |
| 2002/0080834 | A1 | 6/2002 | Kusunose |
| 2002/0185976 | A1 | 12/2002 | Weaver et al. |
| 2003/0052609 | A1 | 3/2003 | Eastlund |
| 2003/0068012 | A1 | 4/2003 | Ahmad |
| 2003/0098638 | A1 | 5/2003 | Beech et al. |
| 2003/0147499 | A1 | 8/2003 | Kondo |
| 2003/0168982 | A1 | 9/2003 | Kim |
| 2003/0231496 | A1 | 12/2003 | Sato |
| 2004/0016894 | A1 | 1/2004 | Wester |
| 2004/0026512 | A1 | 2/2004 | Otsubo |
| 2004/0129896 | A1 | 7/2004 | Schmidt |
| 2004/0163031 | A1 | 9/2004 | Silverman et al. |
| 2004/0183031 | A1 | 9/2004 | Silverman |
| 2004/0183038 | A1 | 9/2004 | Hiramoto et al. |
| 2004/0238762 | A1 | 12/2004 | Mizoguchi et al. |
| 2004/0264512 | A1 | 12/2004 | Hartlove et al. |
| 2005/0099130 | A1 | 5/2005 | Espiau et al. |
| 2005/0167618 | A1 | 8/2005 | Hoshino et al. |
| 2005/0205811 | A1 | 9/2005 | Partlo et al. |
| 2005/0207454 | A1 | 9/2005 | Starodoumov et al. |
| 2005/0225739 | A1 | 10/2005 | Hiura |
| 2005/0243390 | A1 | 11/2005 | Tejnil |
| 2006/0039435 | A1 | 2/2006 | Cheymol |
| 2006/0097203 | A1 | 5/2006 | Byankov et al. |
| 2006/0109455 | A1 | 5/2006 | Haverlag |
| 2006/0131515 | A1 | 6/2006 | Partlo |
| 2006/0152128 | A1 | 7/2006 | Manning |
| 2006/0175947 | A1 | 8/2006 | Blondia et al. |
| 2006/0192152 | A1 | 8/2006 | Ershov |
| 2006/0219957 | A1 | 10/2006 | Ershov |
| 2007/0115468 | A1 | 5/2007 | Barnard |
| 2007/0228288 | A1 | 10/2007 | Smith |
| 2007/0228300 | A1 | 10/2007 | Smith |
| 2007/0272832 | A1 | 11/2007 | Fujimatsu et al. |
| 2007/0285921 | A1 | 12/2007 | Zulim et al. |
| 2008/0055712 | A1 | 3/2008 | Noelscher |
| 2008/0203922 | A1 | 8/2008 | Guthrie et al. |
| 2008/0280079 | A1 | 11/2008 | Watanabe |
| 2009/0032740 | A1 | 2/2009 | Smith et al. |
| 2009/0140651 | A1 | 6/2009 | Hori |
| 2009/0230326 | A1 | 9/2009 | Vaschenko et al. |
| 2010/0045197 | A1 | 2/2010 | Kessels |
| 2010/0140373 | A1 | 6/2010 | Myhre et al. |
| 2010/0181503 | A1 | 7/2010 | Yanagida et al. |
| 2010/0221484 | A1 | 9/2010 | Meade et al. |
| 2010/0264820 | A1 | 10/2010 | Sumitomo |
| 2011/0181191 | A1 | 7/2011 | Smith |
| 2011/0204265 | A1 | 8/2011 | Smith |
| 2012/0112624 | A1 | 5/2012 | Jeong |
| 2013/0052903 | A1 | 2/2013 | Gilliard et al. |
| 2013/0329204 | A1 | 12/2013 | Pellemans et al. |
| 2014/0126043 | A1 | 5/2014 | Senekerimyan |
| 2014/0362600 | A1 | 12/2014 | Suckling |
| 2015/0034838 | A1* | 2/2015 | Bezel ..... H01J 65/04 250/432 R |
| 2015/0201483 | A1* | 7/2015 | Bezel ..... H05H 1/24 250/503.1 |
| 2015/0262808 | A1 | 9/2015 | Wang |
| 2015/0332908 | A1* | 11/2015 | Blondia ..... H01J 61/16 313/111 |
| 2015/0357179 | A1 | 12/2015 | Wilson et al. |
| 2016/0057845 | A1 | 2/2016 | Smith |

FOREIGN PATENT DOCUMENTS

| | | | |
|---|---|---|---|
| EP | 1335640 | | 8/2003 |
| FR | 2554302 | A | 5/1985 |
| JP | S61-193358 | A | 8/1986 |
| JP | H04-144053 | A | 5/1992 |
| JP | 08299951 | | 11/1996 |
| JP | 2003-317675 | A | 11/2003 |
| JP | 2006010675 | A | 1/2006 |
| NL | 8403294 | | 6/1985 |
| WO | 2004097520 | A2 | 11/2004 |
| WO | WO2007120521 | | 10/2007 |

(56) References Cited

FOREIGN PATENT DOCUMENTS

| | | |
|---|---|---|
| WO | WO2010002766 | 1/2010 |
| WO | 2010093903 | 8/2010 |

OTHER PUBLICATIONS

Christian Stewen; A 1-kW CW Thin Disc Laser, IEEE Journal of Selected Topics in Quantum Electronics, vol. 6, No. 4, Jul./Aug. 2000.
Hecht, Eugene; Optics, 4ed; Pearson Addison Wesley; 2002; pp. 149-171, 243-273, 385-442.
KLA-Tencor; High Power Laser-Sustained Plasma Light Sources for KLA-Tencor Broadband Inspection Tools; Conference Paper• May 2015.
Davis, Christopher C.; Lasers and Electro-Optics; Fundamentals and Engineering; 1996, Cambridge University Press, pp. 14-35.
Tarn, Quasiresonant laser-produced plasma: an efficient mechanism for localized breakdown; J. Appl. Phys. 51(9), Sep. 1980, p. 4682.
Measures, et al; Laser Interaction based on resonance saturation (LIBORS): an alternative to inverse bremsstrahlung for coupling laser energy into a plasma; Applied Optics, vol. 18, No. 11, Jun. 1, 1979.
Eletskii el al; Formation kinetics and parameters of a photoresonant plasma; Sov. Phys. JETP 67 (5); May 1988.
Ballman, et al; Synthetic Quartz with High Ultraviolet Transmission; Applied Optics; Jul. 1968, vol. 7, No. 7.
Energetiq Technology, Inc; LDLS™ Laser-Driven Light Source Data Sheet; 2008.
Patel and Zaidi, The suitability of sapphire for laser windows, MEas. Sci. Technol. 10 (1999).
Waynant, et al; Electro-Optics Handbook, Second Edition; Chapter 10; published by McGraw-Hill, 2000.
Excelitas Technologies Corp.; Cermax® Xenon Lamp Engineering Guide, 2011.
Perkinelmer Optoelectronics; Cermax® Xenon Lamp Engineering Guide, 1998.
G C Wei; Transparent ceramic lamp envelope materials; J. Phys. D: Appl. Phys. 38 (2005) 2057-3065.
Pasco Scientific; Instruction Sheet for the PASCO Model OS-9286A Mercury Vapor Light Source; 1990.
Generalov et al; "Continuous Optical Discharge," ZhETF Pis. Red. 11, No. 9, May 5, 1970, pp. 302-304.
Kozlov et al; "Radiative Losses by Argon Plasma and the Emissive Model of a Continuous Optical Discharge"; Sov. Phys.JETP, vol. 39, No. 3, Sep. 1974, pp. 463-468.
Wibers et al, "The Continuum Emission of an Arc Plasma," J. Quant. Spectrosc. Radiat, Transfer, vol. 45, No. 1, 1991, pp. 1-10
Wilbers, et al "The VUV Emissilivity of a High-Pressure Cascade Argon Arc from 125 to 200 nm." J.Quant. Spectrosc. Radiat. Transfer, vol. 46, 1991, pp. 299-308.
Luxtell LLC CeraLux Xenon Lamps Product Data Sheet; 2003-2004.
Laufer, Gabriel; Introduction to Optics and Lasers in Engineering; pp. 449-454 Cambridge University Press, 1996.
Yu, et al; LED-Based Projection Systems; Journal of Display Technology, vol. 3, No. 3, Sep. 2007.
Derra et al; UHP lamp systems for projection applications; J. Phys. D: Appl. Phys. 38 (2005) 2995-3010.
Ingle, James D., et al; Spectrochemical Analysis; 1988, Prentice-Hall Inc.; p. 59.
M.J. Soileau et al., Laser-Induced Damage Measurements in CdTe and Other II-VI Materials, Applied Optics, vol. 21, No. 22, pp. 4059-4062 .
Roy Henderson et al., Laser Safety, pp. 435-443 (2004).
Turan Erdogan, Ph.D., CTO Semrock, Inc., A Unit of IDEX Corp; letter dated Feb. 28, 2011 regarding Energetiq Technology's EQ-99 system.
Winners of 2010 Prism Awards Announced, Jan. 27, 2011; webpage from photonics.com.
http://www.rdmag.com/award-winners/2011/08/light-source-lifetime-lifted-laser-tech; The EQ-99 LDLS Laser-Driven Light Source, produced by Energetiq Technology Inc. 2011.
Energetiq Technology Inc. Press Release: Energetiq Announces Ultra-Compact Light. Source for Next Generation HPLC and Advanced Microscopy; Jan. 21, 2010.
KLA-Tencor Launches 2830 and Puma 9500 Series, eDR-5210 | Product Releases | Press Releases; Jul. 13, 2009.
International Search Report for PCT Application No. PCT/US2015/030740 dated Oct. 20, 2015.
Partial International Search Report for PCT Application No. PCT/US2015/030740, dated Aug. 11, 2015, 2 pages.
Excelitas Technologies; Cermax® Xenon Lamp Engineering Guide, Copyright 2011, www.excelitas.com.
Partial Search Report for PCT/US2016/031983 dated Aug. 16, 2016.
International Search Report for PCT/US16/32022, dated Jun. 24, 2016.
I.M. Beterov et al., "Resonance radiation plasma (photoresonance plasma)", Sov. Phys. Usp. 31 (6), 535 (1988).
D. Keefer, "Laser Sustained Plasmas," Chapter 4, in Radziemski et al., "Laser-Induced Plasmas and Applications," CRC Press (1989).
Norbert R. Böwering et al., "EUV Source Collector," Proc. of SPIE vol. 6151, (Mar. 10, 2006).
William T. Silfvast, Laser Fundamentals, 2d ed., pp. 1-6 (2004).
Arp et al., Feasibility of generating a useful laser-induced breakdown spectroscopy plasma on rocks at high pressure: preliminary study for a Venus mission, published Jul. 30, 2004.
J. Uhlenbusch and W. Viöl, "Hβ-Line Profile Measurements in Optical Dischagres", J. Quant. Spectrosc. Radiat. Transfer, vol. 44, No. 1, 47-56 (1990).
DS004 EQ-10M—Data Sheet, Energetiq, 2005.
John Powell and Claes Magnusson; Handbook of Laser Technologies and Applications Volume III Applications, Part D:1.2, pp. 1587-1611; 2004, published by Institute of Physics Publishing.
Digonnet, Michel J.F., editor; Rare-Earth-Doped-Fiber Lasers and Amplifiers, Second Edition, Revised and Expanded, published by Marcel Dekker, Inc., 2001, pp. 144-170.
Cremers, et al; Evaluation of the Continuous Optical Discharge for Spectrochemical Analysis; Spechtrochimica Acta, Part B. Atomic Spectroscopy; vol. 40B No. 4, 1985.
ASML's customer magazine, 2014, ASML Holding BV.
Raizer, Yuri P.; Gas Discharge Physics, Springer-Verlag 1991; pp. 35-51; 307-310.
Raizer, Yuri P.; Gas Discharge Physics, Springer-Verlag corrected and printing 1997; pp. 35-51; 307-310.
V. P. Zimakov, et al; Interaction of Near-IR Laser Radiation with Plasma of a Continuous Optical Discharge; Plasma Physics Reports, 2016, vol. 42, No. 1, pp. 68-73.
Bezel, et al "High Power Laser-Sustained Plasma Light Sources for KLA-Tencor Broadband Inspection Tool"; Conference Paper • May 2015, KLATencor, Milpitas, California.
Energetiq Technology, Inc.; LDLS™ Laser-Driven Light Source EQ-1000 High Brightness DUV Light Source Data Sheet; 2008; Woburn, Massachusetts.
Rudoy, et al; Xenon Plasma Sustained by Pulse-Periodic Laser Radiation; Plasma Physics Reports, 2015, vol. 41, No. 10, pp. 858-861, Pleiades Publishing, Ltd., 2015.
Knecht, et al; Optical pumping of the XeF(C-+A) and iodine 1.315-pm lasers by a compact surface discharge system; Opt. Eng. 42(12) 3612-3621 (Dec. 2003).
Fridman, et al; Plasma Physics and Engineering; Published in 2004 by Taylor & Francis, pp. 404-419; 618-619.
Model EQ-99 LDLS™ Laser-Driven Light Source; Operation and Maintenance Manual Revision Mar. 2, 2012.
Martin van den Brink; Many ways to shrink: The right moves to 10 nanometer and beyond; Presentation at ASML SmallTalk 2014; London; Nov. 2014.
Laser Pumped Plasma Broadband Light Source by RnD Isan (no date).
Toumanov; Plasma and High Frequency Processes for Obtaining and Processing Materials in the Nuclear Fuel Cycle; Nova Science Publishers, Inc., New York, 2003, p. 60.

(56) References Cited

OTHER PUBLICATIONS

Klauminzer; Cost Considerations for Industrial Excimer Lasers; Laser Focus, The Magazine of Electro-Optics Technology; Dec. 1985.
S. C. Tidwell, ; Highly efficient 60-W TEMoo cw diode-end-pumped Nd:YAG laser; Optics Letters / vol. 18, No. 2 / Jan. 15, 1993, pp. 116-118.
R. J. Shine, Jr; 40-W cw, TEM00-mode, diode-laser-pumped, Nd:YAG miniature-slab laser, Mar. 1, 1995 / vol. 20, No. 5 / Optics Letters; pp. 459-461.
W. Schone, et al; Diode-Pumped High-Power cw Nd:YAG Lasers; W. Waidelich, et al (eds.); Laser in Forschung and Technik; 1996.
Diogiovanni, et al; High Power Fiber Lasers and Amplifiers; Optics & Photonics News, Jan. 1999.
ASML YieldStar T-250D product sheet; ASML Product Catalog; Jan. 20, 2014.
ASML YieldStar S-250D product sheet; SML Product Catalog; Jan. 20, 2014.
Energetiq Technology Inc; Operation manual for LDLS™ Laser-Driven Light Source; Aug. 2009.
Bussiahn; Experimental and theoretical investigations of a low-pressure He—Xe discharge for lighting purpose; Journal of Applied Physics vol. 95, No. 9 May 1, 2004.
V.P. Zimakov, et al; Bistable behavior of a continuous optical discharge as a laser beam propagation effect; Laser Resonators, Microresonators, and Beam Control XV; vol. 8600, 860002 • © 2013 SPIE.
Fridman, et al; Plasma Physics and Engineering, Second Edition; Published in 2011 by Taylor & Francis, pp. 409-424; 639-640.
Energetiq Technology, Inc.; Model EQ-1500, LDLS™ Laser-Driven Light Source, Operation Manual, May 2011.
Energetiq Technology, Inc.; Model EQ-77 LDLS™ Laser-Driven Light Source, Operation Manual, Dec. 2015.
Energetiq Technology, Inc.; Model EQ-90-FC, LDLS™ Laser-Driven Light Source, Operation and Maintenance Manual, Jan. 2014.
Raizer, "Optical discharges," Soviet Physics Uspekhi 23(11) (1980).
Energetiq Technology, Inc.; Operation and Maintenance Manual, Model EQ-99X, LDLS Laser-Driven, Light Source, Rev. 1 (Jan. 2014).
Energetiq Technology, Inc.; Operation and Maintenance Manual, Model EQ-99-FC, LDLS Laser-Driven Light Source, Rev. 2 (Mar. 2012).
Energetiq Technology, Inc.; Operation and Maintenance Manual, Model EQ-99X-FC, LDLS Laser Driven Light Source, Rev. 1 (Jan. 2014).
Energetiq Technology, Inc.; Operation and Maintenance Manual, Model EQ-9-N, LDLS Laser-Driven Light Source, Rev. 6 (Sep. 2015).
Energetiq Technology, Inc.; A presentation titled "EQ-400 LDLS Laser-Driven Light Source," dated Feb. 2, 2015.
A presentation titled "Eneretiq Laser-Driven Light Sources," dated Apr. 21, 2015.
A presentation titled "ASML BV LDLS Roadmap," dated Jun. 11, 2013.
Nanometrics, Organic Growth Opportunities for Nanometrics in Process Control.
A presentation titled "LDLS Laser-Driven Light Source," dated Jul. 8, 2011.
Castellano, "Are the Brains at ASML Hurting Investors With High and Ambitious R&D Costs?" Jul. 20, 2015.
M. W. P. Cann, Light Sources in the 0.15-20-μ Spectral Range, vol. 8 No. 8 Applied Optics (1969).
Kuhn, Kelin; Laser Engineering; Prentice-hall Inc, 1998; pp. 384-440.
Moulton, Peter F., Tunable Solid-State Lasers; Proceedings of the IEEE, vol. 80, No. 3, Mar. 1992.
Koch, K.K.; Sodium Plasma Produced by Milliwatt cw Laser Irradiation; Journal of the Optical Society of America; vol. 70, No. 6; Jun. 1980.
E. B. Saloman; Energy Levels and Observed Spectral Lines of Xenon, Xel through XeLIV; J. Phys. Chem. Ref. Data, vol. 33, No. 3, 2004.
Lothar Klein; Measurements of Spectral Emission and Absorption of a High Pressure Xenon Arc in the Stationary and the Flashed Modes; Apr. 1968; vol. 7, No. 4, Applied Optics.
Hailong Zhou, et al; Conductively cooled high-power, high-brightness bars and fiber coupled arrays; High-Power Diode Laser Technology and Applications III, edited by Mark S. Zediker, Proc. of SPIE vol. 5711 (SPIE, Bellingham, WA, 2005).
Ytterbium-doped large-core fibre laser with 1 kW of continuous-wave output power; Y. Jeong, et al; Electronics Letters Apr. 15, 2004, vol. 40 No. 8.
Bussiahn, R. et al, "Experimental and theoretical investigations of a low-pressure He—Xe discharge for lighting purpose" Journal of Applied Physics, vol. 95, No. 9. May 1, 2004, pp. 4627-4634.
Beck, "Simple Pulse Generator for Pulsing Xenon Arcs with High Repetition Rate," Rev. Sci. Instrum., vol. 45, No. 2, Feb. 1974, pp. 318-319.
Carlhoff, et al, "Continuous Optical Discharges at Very High Pressure," Physica 103C, pp. 439-447.
Fiedorowicz et al, X-Ray Emission from Laser-Irradiated Gas Puff Targets, Appl. Phys. Lett. 62 (22). May 31, 1993.
Franzen, "CW Gas Breakdown in Argon Using 10.6-urn Laser Radiation," Appl. Phys. Lett. vol. 21, No. 2 Jul. 15, 1972 pp. 62-64.
Jeng et al, Theoretical Investigation of Laser-sustained Argon Plasmas J.Appl.Phys. 60 (7), Oct. 1, 1986 pp. 2272-2279.
Nakar, "Radiometric Characterization of Ultrahigh Radiance Xenon Short-arc Discharge Lamps" Applied Optics, vol. 47 No. 2, Jan. 9, 2008, pp. 224-229.
Moody, "Maintenance of a Gas Breakdown in Argon Using 10.6-u cw Radiation," Journal of Applied Physics, vol. 46, No. 6, Jun. 1975, pp. 2475-2482.
Keefer, et al "Experimental Study of a Stationary Lesser-Sustained Air Plasma", Journal of Applied Physics, vol. 46., No. 3, Mar. 1975, pp. 1080-1083.
Nanometrics, Organic Growth Opportunities for Nanometrics in Process Control, Jan. 2016.
M.J. Soileau et al., Laser-Induced Damage Measurements in CdTe and Other II-VI Materials, Applied Optics, vol. 21, No. 22, pp. 4059-4062; Nov. 15, 1982.

* cited by examiner

FIG. 1
(PRIOR ART)
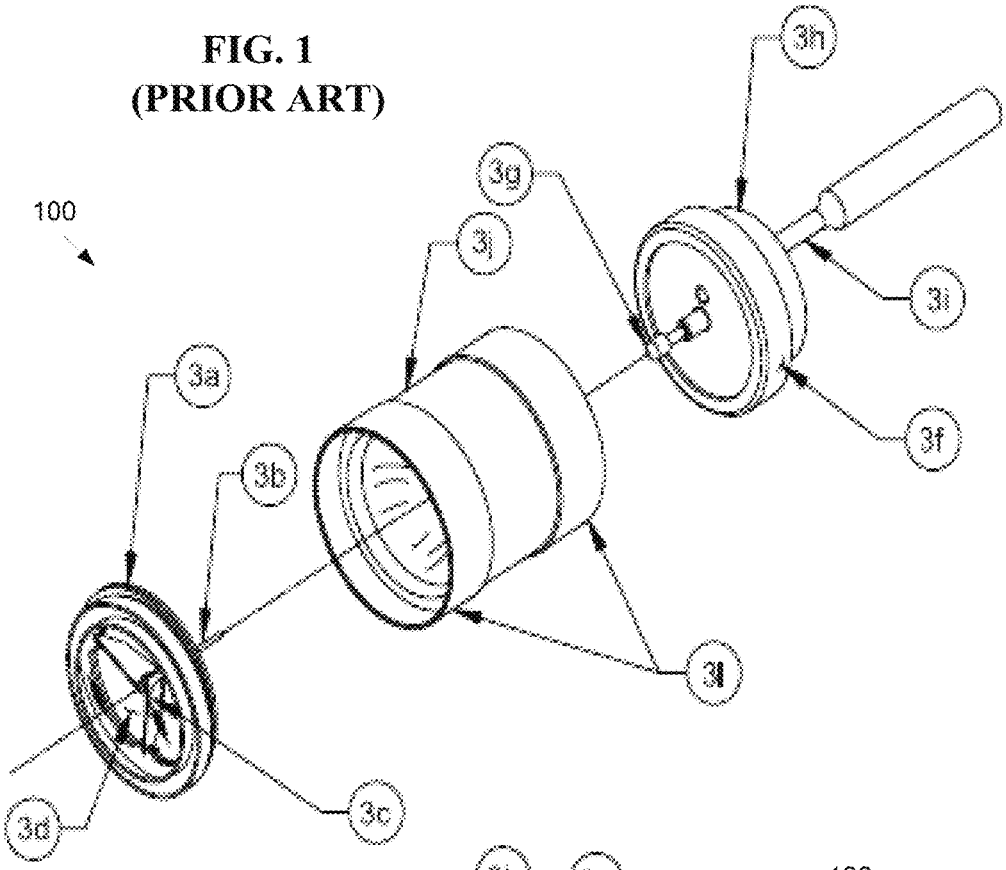
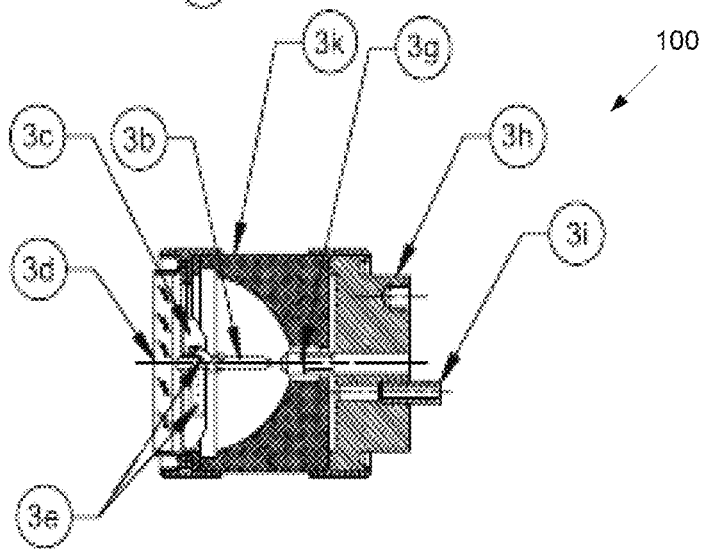
FIG. 2
(PRIOR ART)

MECHANICALLY SEALED TUBE FOR LASER SUSTAINED PLASMA LAMP AND PRODUCTION METHOD FOR SAME

FIELD OF THE INVENTION

The present invention relates to illumination devices, and more particularly, is related to high-intensity arc lamps.

BACKGROUND OF THE INVENTION

High intensity arc lamps are devices that emit a high intensity beam. The lamps generally include a gas containing chamber, for example, a glass bulb, with an anode and cathode that are used to excite the gas (ionizable medium) within the chamber. An electrical discharge is generated between the anode and cathode to provide power to the excited (e.g. ionized) gas to sustain the light emitted by the ionized gas during operation of the light source.

FIG. 1 shows a pictorial view and a cross section of a low-wattage parabolic prior art Xenon lamp 100. The lamp is generally constructed of metal and ceramic. The fill gas, Xenon (Xe), is inert and nontoxic. The lamp subassemblies may be constructed with high-temperature brazes in fixtures that constrain the assemblies to tight dimensional tolerances. FIG. 2 shows some of these lamp subassemblies and fixtures after brazing.

There are three main subassemblies in the prior art lamp 100: cathode; anode; and reflector. A cathode assembly 3*a* contains a lamp cathode 3*b*, a plurality of struts holding the cathode 3*b* to a window flange 3*c*, a window 3*d*, and getters 3*e*. The lamp cathode 3*b* is a small, pencil-shaped part made, for example, from thoriated tungsten. During operation, the cathode 3*b* emits electrons that migrate across a lamp arc gap and strike an anode 3*g*. The electrons are emitted thermionically from the cathode 3*b*, so the cathode tip must maintain a high temperature and low-electron-emission to function.

The cathode struts 3*c* hold the cathode 3*b* rigidly in place and conduct current to the cathode 3*b*. The lamp window 3*d* may be ground and polished single-crystal sapphire (AlO2). Sapphire allows thermal expansion of the window 3*d* to match the flange thermal expansion of the flange 3*c* so that a hermetic seal is maintained over a wide operating temperature range. The thermal conductivity of sapphire transports heat to the flange 3*c* of the lamp and distributes the heat evenly to avoid cracking the window 3*d*. The getters 3*e* are wrapped around the cathode 3*b* and placed on the struts. The getters 3*e* absorb contaminant gases that evolve in the lamp during operation and extend lamp life by preventing the contaminants from poisoning the cathode 3*b* and transporting unwanted materials onto a reflector 3*k* and window 3*d*. The anode assembly 3*f* is composed of the anode 3*g*, a base 3*h*, and tubulation 3*i*. The anode 3*g* is generally constructed from pure tungsten and is much blunter in shape than the cathode 3*b*. This shape is mostly the result of the discharge physics that causes the arc to spread at its positive electrical attachment point. The arc is typically somewhat conical in shape, with the point of the cone touching the cathode 3*b* and the base of the cone resting on the anode 3*g*. The anode 3*g* is larger than the cathode 3*b*, to conduct more heat. About 80% of the conducted waste heat in the lamp is conducted out through the anode 3*g*, and 20% is conducted through the cathode 3*b*. The anode is generally configured to have a lower thermal resistance path to the lamp heat sinks, so the lamp base 3*h* is relatively massive. The base 3*h* is constructed of iron or other thermally conductive material to conduct heat loads from the lamp anode 3*g*. The tubulation 3*i* is the port for evacuating the lamp 100 and filling it with Xenon gas. After filling, the tabulation 3*i* is sealed, for example, pinched or cold-welded with a hydraulic tool, so the lamp 100 is simultaneously sealed and cut off from a filling and processing station. The reflector assembly 3*j* consists of the reflector 3*k* and two sleeves 3*l*. The reflector 3*k* may be a nearly pure polycrystalline alumina body that is glazed with a high temperature material to give the reflector a specular surface. The reflector 3*k* is then sealed to its sleeves 3*l* and a reflective coating is applied to the glazed inner surface.

During operation, the anode and cathode become very hot due to electrical discharge delivered to the ionized gas located between the anode and cathode. For example, ignited Xenon plasma may burn at or above 15,000 C, and a tungsten anode/cathode may melt at or above 3600 C degrees. The anode and/or cathode may wear and emit particles. Such particles can impair the operation of the lamp, and cause degradation of the anode and/or cathode.

For existing laser sustained plasma lamps constructed with traditional brazing methods, these braze interfaces have to be cooled down to around 300 degrees Celsius for envelope and seal integrity over life of the product. Because of said cooling, the operating temperature of the lamp is not ideal to minimize gas turbulence in the envelopes of such lamps. It has been shown that operating at a higher lamp envelope temperature minimizes gas turbulence significantly with an improved plasma stability and higher radiance over aperture as a direct result. Similarly, some existing laser sustained plasma lamps are formed of a material that is not compatible with a mercury enhanced fill gas to obtain high internal operating pressure. Therefore, there is a need to address one or more of the above mentioned shortcomings.

SUMMARY OF THE INVENTION

Embodiments of the present invention provide a mechanically sealed tube for a laser sustained plasma lamp and a production method for same. Briefly described, the present invention is directed to a laser sustained plasma lamp having a mechanically sealed pressurized chamber assembly configured to contain an ionizable material. The chamber assembly is bounded by a chamber tube, an ingress sapphire window, a first metal seal ring configured to seal against the chamber tube ingress end and the ingress sapphire window, an egress sapphire window, and a second metal seal ring configured to seal against the chamber tube egress end and the egress sapphire window. A mechanical clamping structure external to the chamber assembly is configured to clamp across at least a portion of the ingress sapphire window and the egress sapphire window. The ingress sapphire window and the egress sapphire window are not connected to the chamber tube via welding and/or brazing.

Other systems, methods and features of the present invention will be or become apparent to one having ordinary skill in the art upon examining the following drawings and detailed description. It is intended that all such additional systems, methods, and features be included in this description, be within the scope of the present invention and protected by the accompanying claims.

BRIEF DESCRIPTION OF THE DRAWINGS

The accompanying drawings are included to provide a further understanding of the invention, and are incorporated in and constitute a part of this specification. The components in the drawings are not necessarily to scale, emphasis instead being placed upon clearly illustrating the principles of the present invention. The drawings illustrate embodiments of the invention and, together with the description, serve to explain the principles of the invention.

FIG. 1 is a schematic diagram of a prior art high intensity lamp in exploded view.

FIG. 2 is a schematic diagram of the prior art high intensity lamp of FIG. 1 in cross-section view.

DETAILED DESCRIPTION

Figure 3A:
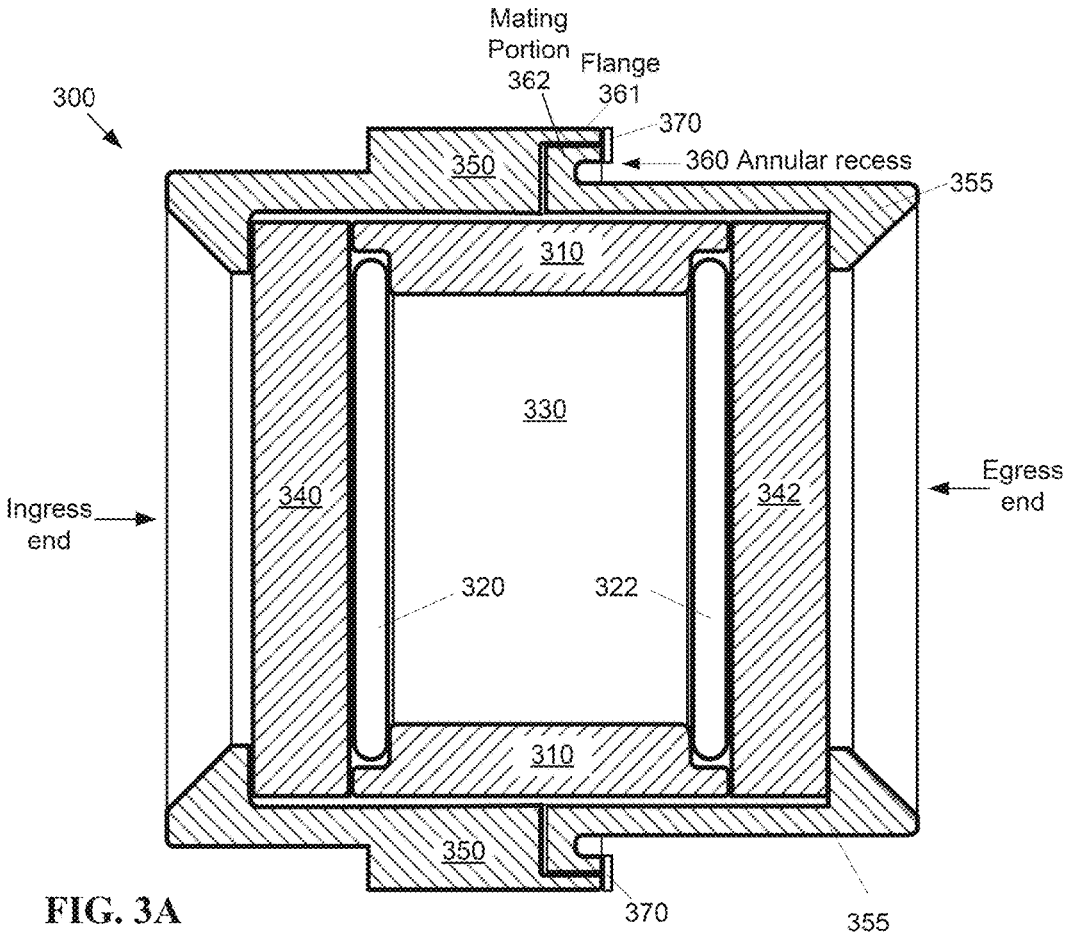
FIG. 3A is a schematic cutaway side view of a first embodiment of a sealed high intensity lamp.

The following definitions are useful for interpreting terms applied to features of the embodiments disclosed herein, and are meant only to define elements within the disclosure.

As used within this disclosure, a lens refers to an optical element that redirects/reshapes light passing through the optical element. In contrast, a mirror or reflector redirects/reshapes light reflected from the mirror or reflector.

As used within this disclosure, a direct path refers to a path of a light beam or portion of a light beam that is not reflected, for example, by a mirror. A light beam passing through a lens or a flat window is considered to be direct.

As used within this disclosure, "substantially" means "very nearly," or within normal manufacturing tolerances. For example, a substantially flat window, while intended to be flat by design, may vary from being entirely flat based on variances due to manufacturing.

Reference will now be made in detail to embodiments of the present invention, examples of which are illustrated in the accompanying drawings. Wherever possible, the same reference numbers are used in the drawings and the description to refer to the same or like parts.

Laser sustained plasma lamps include a pressurized chamber containing ionizable media (noble gas mixture) that is ignited to form a plasma and sustained by laser light entering the chamber (or envelope) via an ingress window. As noted in the Background section, high intensity light produced by the plasma is emitted from the chamber, for example, via an egress window or waveguide. Plasma lamp chambers have been constructed with traditional brazing methods, where the operating temperature of the lamp must be capped to keep the braze interfaces around 300 degrees Celsius or below for envelope and seal integrity over the life of the lamp. However, such an operating temperature is not ideal to minimize gas turbulence within the chamber. Further the brazing materials may not be compatible with certain ionizable media. Envelopes where Sapphire windows are welded to Sapphire tubes have been difficult and expensive to produce (see U.S. Pat. No. 9,230,771 B2).

Figure 3B:
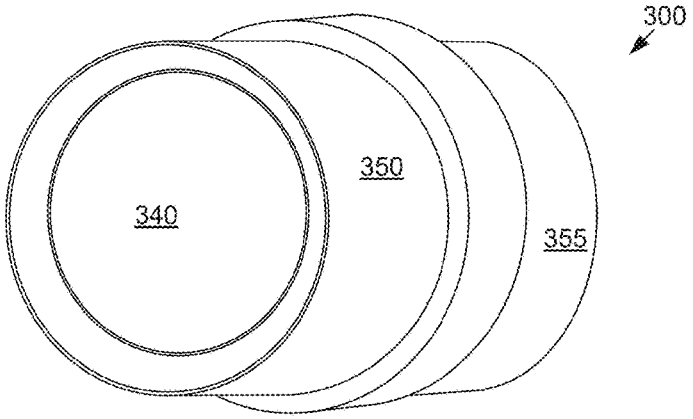
FIG. 3B is a schematic perspective view of the lamp of FIG. 3A.
Figure 4A:
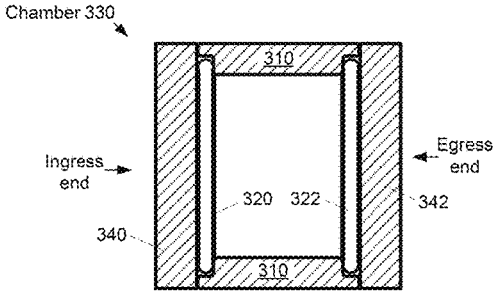
FIG. 4A is a schematic cutaway diagram detailing the chamber of the lamp of FIG. 3A.
Figure 4B:
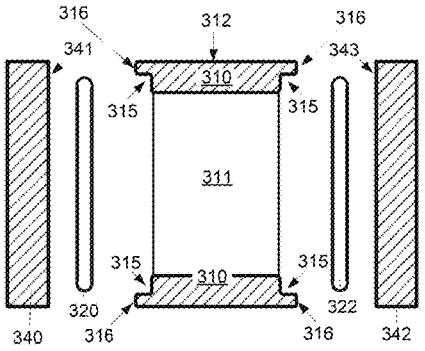
FIG. 4B is a schematic exploded cutaway diagram of the chamber of FIG. 4A.
Figure 4C:
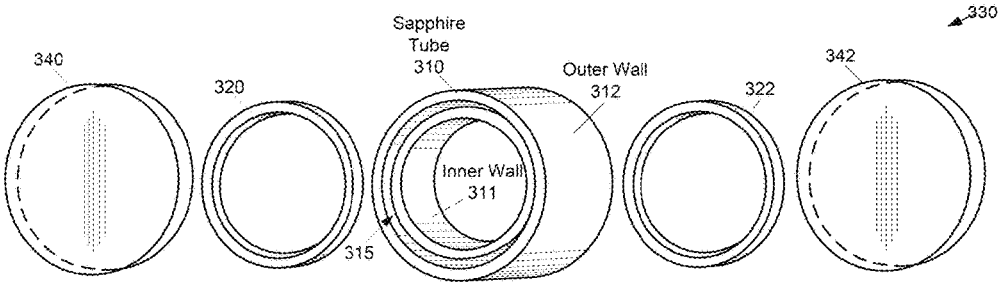
FIG. 4C is a schematic exploded perspective diagram of the chamber of FIG. 4A.

The first exemplary embodiment is directed to a sealable pressurized laser sustained plasma lamp 300 having a sapphire chamber (or "envelope"). FIG. 3A shows a cross section of a first exemplary embodiment of a laser sustained plasma lamp 300, while FIG. 3B shows a perspective view of the laser sustained plasma lamp 300. The lamp 300 includes a sapphire tube 310, which is shown in more detail in FIGS. 4A, 4B and 4C. Under the first embodiment, the sapphire tube 310 is substantially cylindrical in shape, having an interior wall 311 and an exterior wall 312. There are two substantially flat precision finished, ground, and polished sapphire windows 340, 342 capping respective ends of the sapphire tube 310, namely, an ingress sapphire window 340 and an egress sapphire window 342. Each end of the sapphire tube 310 includes an inset portion 315, such that a height of the cylindrical exterior wall 312 is greater than a height of the cylindrical interior wall 311, and the exterior wall 312 overhangs the interior wall at both ends of the sapphire tube 310. A flat portion 316 at a first end of the exterior wall 312 having a ring-shaped surface, faces, but may not directly contact, an interior surface 341 of the ingress sapphire window 340. Similarly, a flat portion 316 at a second end of the exterior wall 312 having a ring-shaped surface, faces, but may not directly contact, an interior surface 343 of the egress sapphire window 342. The inset portion 315 provides a ring-shaped gap volume to accommodate an ingress metal seal ring 320 at the first end of the sapphire tube 310, and to accommodate an egress metal seal ring 322 at the second end of the sapphire tube 310.

The ingress metal seal ring 320 may be in contact with both the flat portion 316 of the sapphire tube 310 and the interior surface 341 of the ingress sapphire window 340, to provide a seal therebetween. Likewise, the egress metal seal ring 322 may be in contact with both the flat portion 316 of the sapphire tube 310 and the interior surface 343 of the egress sapphire window 342, to provide a seal therebetween. Preferably, the sapphire tube 310 does not directly contact either the ingress sapphire window 340 or the egress sapphire window 342, the metal seal rings 320, 322 providing a gap that while very small, serves as buffer for thermal expansion of the windows 340, 342 and/or the sapphire tube 310 in both the egress and ingress directions.

While the inset portions 315 are shown in the drawings as having an L-shaped cross-section, other configurations are possible, for example, a curved cross section. The inset cross-section shape is preferably formed to exert pressure upon the metal mechanical seal rings 320, 322, holding the metal mechanical seal rings 320, 322 between the sapphire windows 340, 342 and the sapphire tube 310.

Rather than brazing the sapphire windows 340, 342 to the sapphire tube 310, the metal mechanical seal rings 320, 322 are used at each end of the tube 310 to seal between the tube 310 and the windows 340, 342. The metal seal rings 320, 322 are configured to fit tight against the sapphire windows 340, 342 and the sapphire tube 310 and provide a seal to contain the ionizable medium, for example, Xenon and/or Krypton, and (when ignited) plasma within the chamber 330. The metal seal rings 320, 322 may be a C-shape, O-shape, V-shape or W-shape, among other possible configurations, and are preferably formed from type 300 stainless steel or Alloy X 750 or Alloy 718, among others.

The metal seal rings 320, 322 may have a compressibility on the order of about 40 microns. While the metal seal rings 320, 322 are preferably soft plated, microscopic leaks may still be possible that over long term can depressurize the cavity 330. In order to ensure an improved seal, the area where the metal seal rings 320, 322 mate with the sapphire tube 310 may optionally be soft coated also, for example, with gold, silver, or (preferably) soft nickel. The seals themselves are configured to handle up to 50,000 psi at temperatures up to 1300 F, or higher.

Portions of the mated surfaces of the sapphire tube 310 and windows 340, 342 and/or the metal surfaces of the metal seal rings 320, 322 may be plated with a soft metal such as gold, silver, or nickel to suppress leakage of the ionizable material from the mechanical seal. The sapphire tube 310 may have one or more sealable portals (not shown) for filling and/or venting the ionizable material.

The chamber assembly 330 may be mechanically held together by an external structure that functions as a clamp applying pressure upon the ingress end of the ingress sapphire window 340 and the egress end of the egress window 342. This clamping pressure may be used to at least partially maintain the seal by the ingress metal seal ring 320 between the ingress sapphire window 340 and the sapphire tube 310, and also the seal by the egress metal seal ring 322 between the egress sapphire window 342 and the sapphire tube 310.

Figure 5:
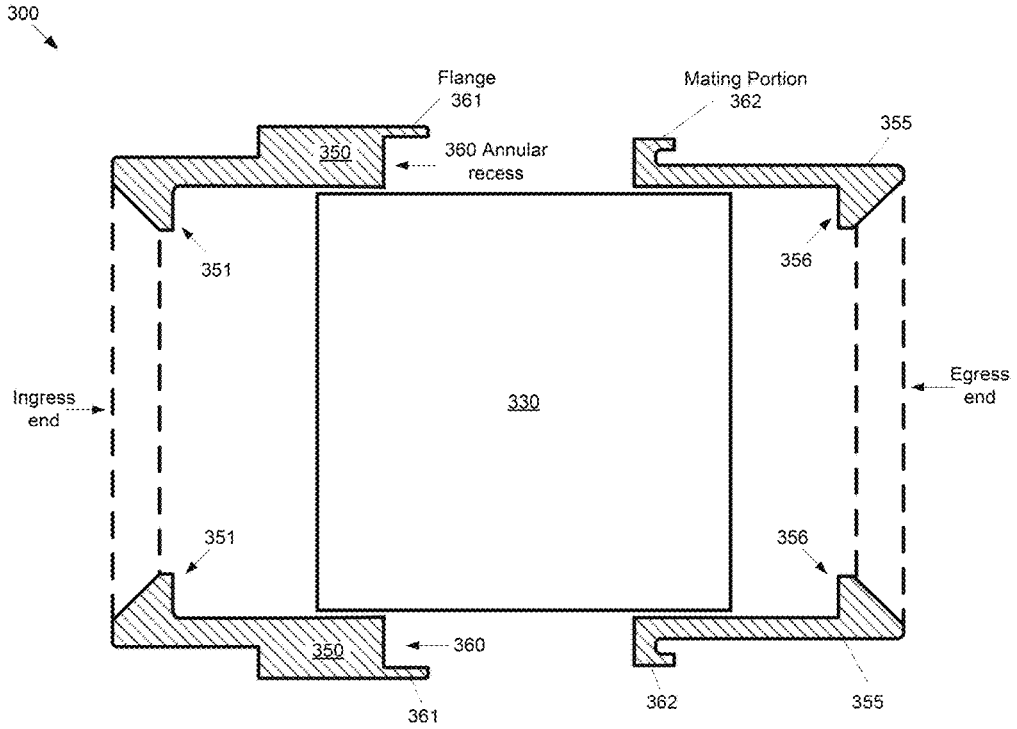
FIG. 5 is a schematic cutaway side view of the shell portion of the lamp of FIG. 3A.

Under the first embodiment, the mechanical clamping is performed by a welded two piece sleeve structure 350, 355. As shown by FIG. 5, a Tungsten Inert Gas (TIG) welded metal sleeved and flanged container assembly formed of a first sleeve portion 350 and a second sleeve portion 355 holds the pressurized plated chamber 330 assembly together. Suitable metals for the sleeve 350, 355 may be selected to match the sapphire thermal expansion coefficients over the operating temperature range of the lamp application, for example Invar, Inconel, or (preferably) Kovar. The other materials may be applicable, for example, to manipulate the expansion coefficient changes over temperatures and elongation. In some embodiments, a combination of different metals may be used for the sleeve 350, 355 to match the sapphire thermal expansion coefficients as expansion coefficients may not be linear over temperature, for example, Kovar, Invar, Inconel and other iron variants.

The first sleeve portion 350 and the second sleeve portion 355 may be substantially cylindrical in shape, so that at least an interior portion of the first sleeve portion 350 and the second sleeve portion 355 conforms to the exterior wall 312 of the chamber assembly 330.

The first sleeve portion 350 may include a first annular inward projecting lip portion 351 configured to abut the ingress sapphire window 340. Similarly, the second sleeve portion 355 may include a second annular inward projecting lip portion 356 configured to abut the egress window 342. When the first sleeve portion 350 is welded to the second sleeve portion 355, the first annular inward projecting lip portion 351 applies pressure to the ingress sapphire window 340, and similarly, the second annular inward projecting lip portion 356 applies pressure to the egress window 342, thereby holding the chamber assembly 330 together.

The first sleeve portion 350 is configured to mate with the second sleeve portion 355 at a weld joint 370 (FIG. 3A) encircling the chamber assembly 330. Under the first embodiment, the first sleeve portion 350 includes a projecting flange 361 configured to overhang and form an annular recess 360. The annular recess 360 is configured to receive a mating portion 362

While under the first embodiment the first sleeve portion 350 and the second sleeve portion 355 are joined at a weld joint 370 across the mating portion 362 and the projecting flange 361 above the within an annular recess 360, other joint configurations are possible.

While FIGS. 3-5 show the first sleeve portion 350 adjacent to the ingress sapphire window 340 and the second sleeve portion 355 adjacent to the egress window 342, in alternative embodiments the first sleeve portion 350 may be configured to be adjacent to the egress window 342 and the second sleeve portion 355 adjacent to the ingress sapphire window 340.

Under alternative embodiments, Kovar or Invar may be used as the tube material instead of sapphire, for example for a lamp operating at temperatures from 300 C up to around 900 C, having an operating pressure within the chamber 330 of up to 3500 psi. The windows 340, 342 may have diameters, for example, between 8 mm and 100 mm. In different embodiments, the windows 340, 342 may be coated to pass and/or reflect desired wavelengths. The windows 340, 342 may be fashioned as ingress and/or egress lenses to shape the ingress laser light and/or the egress high intensity light.

In general, the lamp 300 may not include traditional ignition electrodes, for example, electrodes piercing the sapphire tube 310. Instead, the lamp 300 may ignited via the energy of the ingress laser. Under alternative embodiments, active charge carriers such as Kr-85 and/or an internal passive thoriated tungsten electrode ring may be accommodated within the chamber 330 to facilitate ignition (ionization of the ionizable medium).

Figure 6:
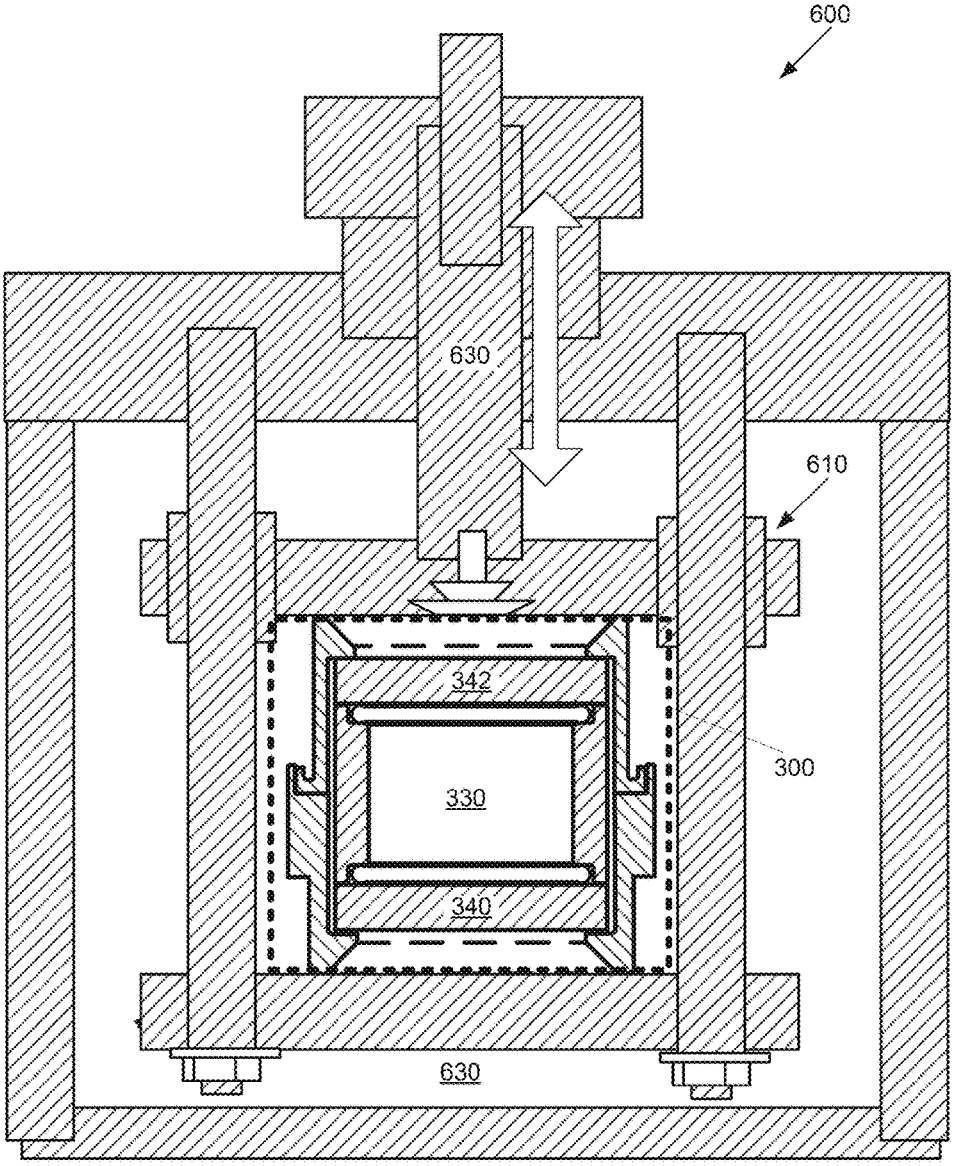
FIG. 6 is a schematic diagram of a pressurized tooling chamber used to manufacture the sealable pressurized laser sustained plasma lamp of FIG. 3A.

As shown by FIG. 6, the assembly and sealing processes may be automated and may be performed in a sealed pressurized tooling chamber 600 with a noble gas (Xe, Ar, He, Kr) atmosphere. A movable rod 630 is used to push the windows 340, 342 and metal seal rings 320, 322 into the pressurized chamber 330 formed by the windows 340, 342 and the tube 310. A final TIG welding sealing step may be performed under atmospheric air.

While the first embodiment includes a chamber assembly 330 with a tube 310, two sapphire windows 340, 342 and two metal seal rings 320, 322, under a second embodiment (not shown), the chamber assembly may have a tube having one open end and a closed end, where the open end is sealed with a window and a metal seal ring in a manner similar to the first embodiment. Other alternative embodiments where the chamber tube is not welded and held together via a welded external structure/clamp are possible.

Figure 7:
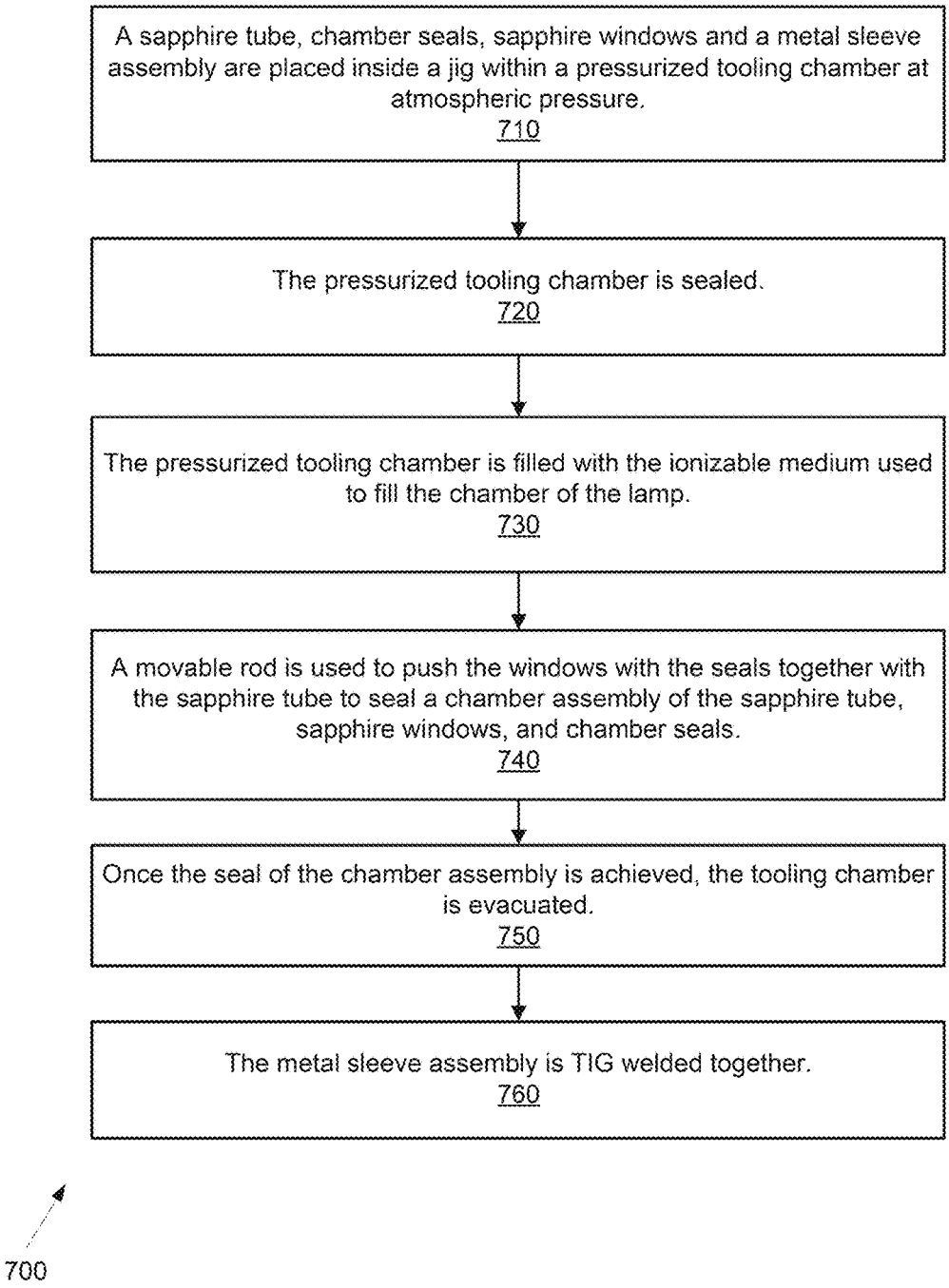
FIG. 7 is a flowchart of an exemplary embodiment of a method for forming the sealable pressurized laser sustained plasma lamp.

FIG. 7 shows a flowchart 700 of an exemplary embodiment of a method for forming the sealable pressurized laser sustained plasma lamp 300. It should be noted that any process descriptions or blocks in flowcharts should be understood as representing modules, segments, portions of code, or steps that include one or more instructions for implementing specific logical functions in the process, and alternative implementations are included within the scope of the present invention in which functions may be executed out of order from that shown or discussed, including substantially concurrently or in reverse order, depending on the functionality involved, as would be understood by those reasonably skilled in the art of the present invention.

As shown by block 710, the components for the lamp 300 (e.g., and the sleeve 350, 355 and the chamber assembly 330 including the tube 310, the metal seal rings 320, 322, and the windows 340, 342) are placed inside a jig 610 within the pressurized tooling chamber 600, for example, at atmospheric pressure. Here, while the components of the chamber assembly 330 are mechanically held in position by the sleeve 350, 355, the chamber assembly 330 is not functionally sealed.

The pressurized tooling chamber 600 is sealed, as shown by block 720. The pressurized tooling chamber 600 is filled with the ionizable medium used to fill the chamber 330 of the lamp 300, as shown by block 730. The pressurized tooling chamber 600 is then pressurized, for example, between 250-2000 psi. A movable rod 630 within the pressurized tooling chamber 600 is used to push the windows 340, 342 and the metal seal rings 320, 322 together with the sapphire tube 310 to form a seal of the chamber assembly 330, as shown by block 740. For example, the rod may compress the lamp 300 against the jig 610.

Once a seal of the chamber assembly 330 is achieved, the tooling chamber is evacuated, as shown by block 750. For example, the engagement of the seals may be measured as the movable rod 630 pushes both sapphire windows 340, 342 against the metal seal rings 320, 322, which may flex a bit as the seals engaged. The fill gas (ionizable medium) may be retrieved for future fill-processing.

The metal sleeve portions 350, 355 are welded together, as shown by block 760, for example, via TIG welding. The movable rod 630 may be released after the TIG welding, the TIG welded sleeve 350, 355 takes over the function of restraining the windows 340, 342. The TIG weld need not be contiguous for 360 degrees around the perimeter of the sleeve 350, 355. For example, three 90% sections or another suitable configuration may suffice to maintain the integrity of the sleeve 350, 355 with respect to the design of the pressurized tooling chamber 600. The TIG welded metal sleeves 350, 355 serve as a clamp to hold the windows 340, 342 and sapphire tube 310 together against all pressure, so the windows 340, 342, which are pushed outward against the sleeves 350, 355 by the chamber assembly 330 internal fill gas pressure, are fully contained over life of the product.

In alternative embodiments, instead of TIG welding the metal sleeves 350, 355 together under atmospheric pressure, the metal sleeves 350, 355 may be brazed before the tooling chamber is evacuated, for example, via a radio frequency (RF) coil embedded within at least one of the metal sleeves 350, 355. A current passing through the RF coil heats the metal sleeves to enable the braze with a nonferrous alloy having a lower melting point than the metal sleeves 350, 355.

While the above method is described with respect to a sapphire window and tube, this method is not limited to a sapphire window and/or sapphire tube sealing. For example, this method may be applied to a sapphire window (or a window of another material) sealing to any high-temperature and chemical inert tube. This method may be utilized to produce a sealed and pressurized environment so that the resulting structure is capable of withstanding plasma temperatures and plasma radiation.

Additionally, the embodiments described above advantageously provide for easy introduction to the lamp chamber of metal halides, mercury and other solids to enhance operational pressure through metal vapors with a direct impact on black body color temperature and associated spectrum and radiance.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A laser sustained plasma lamp (300), comprising:

a mechanically sealed pressurized chamber assembly (330) configured to contain an ionizable material, the chamber assembly comprising and bounded by:

a chamber tube (310) comprising an ingress end and an egress end;

an ingress sapphire window (340) disposed at the chamber tube ingress end;

a first metal seal ring (320) configured to seal against the chamber tube ingress end and the ingress sapphire window;

an egress sapphire window (342) disposed at the chamber tube egress end; and a second metal seal ring (322) configured to seal against the chamber tube egress end and the egress sapphire window; and a mechanical clamping structure (350, 355) external to the chamber assembly configured to clamp across at least a portion of the ingress sapphire window and the egress sapphire window, wherein the ingress sapphire window and the egress sapphire window are not connected to the chamber tube via welding and/or brazing.

2. The lamp of claim 1, wherein the mechanical clamping structure comprises a sleeve comprising an interior surface comporting to an exterior surface of the chamber tube.

3. The lamp of claim 2, wherein the sleeve further comprises:

a first sleeve portion (350) disposed at the chamber tube ingress end; and a second sleeve portion (355) disposed at the chamber tube egress end.

4. The lamp of claim 3, wherein the first sleeve portion is TIG welded to the second sleeve portion.

5. The lamp of claim 3, wherein the first sleeve portion is brazed to the second sleeve portion.

6. The lamp of claim 1, wherein the ingress window and/or the egress window are precision finished, ground, and polished.

7. The lamp of claim 1, wherein the mechanically sealed pressurized chamber is substantially cylindrical in shape.

8. The lamp of claim 1, wherein the chamber tube comprises sapphire.

9. The lamp of claim 1, wherein the first metal seal ring and/or the second metal seal ring comprises a C-shape.

10. The lamp of claim 1, wherein at least a portion of the chamber tube and/or a portion of the ingress and egress windows configured to contact the first and/or second metal seal ring is plated with a soft metal.

11. The lamp of claim 1, wherein the first metal seal ring and/or the second metal seal ring is coated with a soft metal.

12. A method for manufacturing a laser sustained plasma lamp, comprising the steps of:

positioning within a sleeve assembly comprising a first sleeve portion and a second sleeve portion a chamber assembly comprising a chamber tube, a first chamber window, a first chamber seal, a second chamber window, and a second chamber seal;

securing the sleeve assembly and the chamber assembly in a jig within a tooling chamber;

sealing the tooling chamber;

filling the tooling chamber with a pressurized ionizable medium;

compressing the first window, the first seal, the chamber tube, the second seal, and the second window against the jig to seal the chamber assembly; and evacuating the tooling chamber.

13. The method of claim 12, further comprising the step of welding the first sleeve portion and a second sleeve portion together.

14. The method of claim 13, wherein the welding is TIG welding.

15. The method of claim 12, further comprising the step of brazing the first sleeve portion and a second sleeve portion together.

16. A laser sustained plasma lamp, comprising:

a mechanically sealed pressurized chamber assembly configured to contain an ionizable material, the chamber assembly comprising and bounded by:

a chamber tube comprising an open ingress end and a closed end;

a sapphire window disposed at the chamber tube open end;

a metal seal ring configured to seal against the chamber tube open end and the sapphire window;

a mechanical clamping structure external to the chamber assembly configured to clamp across at least a portion of the sapphire window and the chamber tube closed end wherein the sapphire window is not connected to the chamber tube via welding and/or brazing.

* * * * *